US006406349B1

(12) United States Patent
Chung

(10) Patent No.: US 6,406,349 B1
(45) Date of Patent: Jun. 18, 2002

(54) GYROSCOPIC TOY

(75) Inventor: Caleb Chung, Boise, ID (US)

(73) Assignee: ToyInnovation, Inc., Redondo Beach, CA (US)

( * ) Notice: Subject to any disclaimer, the term of this patent is extended or adjusted under 35 U.S.C. 154(b) by 0 days.

(21) Appl. No.: 09/627,614

(22) Filed: Jul. 28, 2000

Related U.S. Application Data

(60) Provisional application No. 60/146,698, filed on Jul. 30, 1999.

(51) Int. Cl.[7] ..... A63H 1/20

(52) U.S. Cl. ..... 446/235; 446/233; 446/247; 446/266

(58) Field of Search ..... 446/236, 245, 446/247, 248, 249, 256, 259, 260, 261, 264, 266

(56) References Cited

U.S. PATENT DOCUMENTS

| | | | | |
|---|---|---|---|---|
| 267,866 A | | 11/1882 | Fouts | |
| 268,318 A | | 11/1882 | Townsend | |
| 462,512 A | | 11/1891 | Sire | |
| 652,593 A | | 6/1900 | Collins | |
| 1,053,040 A | | 2/1913 | Kent | |
| 1,098,895 A | | 6/1914 | Edgar | |
| 1,338,572 A | | 4/1920 | Kerr | |
| 1,351,630 A | | 8/1920 | Edison | |
| 2,062,490 A | | 12/1936 | Arnold | |
| 2,173,031 A | | 9/1939 | Wigal | |
| 2,364,117 A | | 12/1944 | Wigal | |
| 3,137,966 A | | 6/1964 | Lohr | |
| 3,643,373 A | * | 2/1972 | Russell | 446/245 |
| 3,879,887 A | * | 4/1975 | Brookson, Jr. et al. | 446/220 |
| 3,945,146 A | | 3/1976 | Brown | |
| 4,256,306 A | * | 3/1981 | Gross et al. | 446/259 |
| 4,365,437 A | | 12/1982 | Jameson | |
| 4,695,262 A | | 9/1987 | Crosby et al. | |
| 4,772,241 A | | 9/1988 | Bro et al. | |
| 4,867,727 A | | 9/1989 | Lanius | |
| 5,518,437 A | * | 5/1996 | Nonaka et al. | 446/259 |
| 5,593,338 A | * | 1/1997 | Itoh et al. | 446/256 |
| 5,683,284 A | | 11/1997 | Christen | |
| 5,823,845 A | | 10/1998 | O'Berrigan | |
| 5,827,107 A | | 10/1998 | Bears et al. | |
| 6,089,946 A | * | 7/2000 | Yang | 446/259 |

* cited by examiner

*Primary Examiner*—Jacob K. Ackun, Jr.
*Assistant Examiner*—Faye Francis
(74) *Attorney, Agent, or Firm*—Christie, Parker & Hale, LLP

(57) ABSTRACT

A gyroscopic toy is provided having a shaft to which is coupled a flywheel. A drive gear is used to spin the shaft and flywheel for spinning the toy. A pinion gear is rotated to impart spin energy to the shaft and flywheel and thus to the toy. A gearing mechanism couples the drive gear to the pinion gear when the pinion gear is rotated in a first direction and decouples from the drive gear when the pinion gear is rotated in a second opposite direction. A transmission may be provided allowing for at least two different gearing sets to be selectively coupled to the drive gear when the pinion gear is rotated in the first direction.

22 Claims, 11 Drawing Sheets

GYROSCOPIC TOY

CROSS REFERENCE TO RELATED APPLICATION

This application is based upon and claims priority on U.S. Provisional Application No. 60/146,698 filed on Jul. 30, 1999 which is fully incorporated herein by reference.

BACKGROUND OF THE INVENTION

Gyroscopic toys such as toy tops have been around for years. A problem with current tops is that their spin rate and spin time is relatively short. The spin rate and spin time are functions of the amount of energy imparted on the top. A longer spin time is desirable because it allows the person playing with the top to do more tricks of increased complexity.

Some tops incorporate a flywheel for imparting spin energy to the top tip. With these tops, the flywheel is coupled to the tip. Thus, as the flywheel spins so does the tip. The flywheel may be spun with the aid of a string or flexible gear rack. The problem with these tops is that once the flywheel is spinning it is impossible to impart more spin energy to the flywheel for increasing the spin time and/or spin rate of the tops.

Consequently, a gyroscopic toy such as a top is needed that allows its user to impart an increased amount of spin energy on its tip for increasing the spin time and/or spin rate of the gyroscopic toy.

SUMMARY OF THE INVENTION

Gyroscopic toys are provided that can spin at higher speeds and thus incorporate a lighter flywheel. The gyroscopic toys comprise a housing which is typically the toy body. A shaft is coupled to the housing and can rotate relative to the housing. A tip of the shaft extends beyond the housing. A flywheel and a drive gear are coupled to the shaft. A pulley and pinion are coupled via a torsion spring to the housing. A first gear is coupled to the pinion. A string is wound around the pulley. A floating gear is coupled to the first gear and can float from a first position to a second position wherein when in the first position, the floating gear is coupled to the drive gear and to the first gear, and wherein when in the second position, the floating gear is decoupled from the drive gear.

To operate the toy, the user pulls on the string. As a result, the pulley with pinion are rotated coiling the torsion spring. This rotation causes, the floating gear to move radially inward to a position coupled to both the first gear and the drive gear. Consequently, the drive gear is caused to rotate and thus, spin the shaft and flywheel. Once the user releases the string, the torsion spring uncoils causing the pulley/pinion combination to rotate in an opposite direction and coiling the string in the pulley. This opposite rotation causes the first gear to rotate in an opposite direction moving the floating gear in a radially outward direction whereby the floating gear decouples from the drive gear. As the user further pulls on the string he imparts more spin energy on the flywheel as there is less torsional inertia to overcome causing the shaft to spin faster and longer. The more times the user pulls the string the more spin energy imparted to the flywheel and the faster and longer that the toy will spin.

The gear ratio between the gears and specifically the reduction in gearing provided in the gyroscopic toys of the present invention allows for more spin energy to be imparted to the shaft and flywheel. It allows the user to incrementally increase the cumulative spin energy imparted on the flywheel.

In an alternate embodiment, a transmission may be provided that is manual or automatic, allowing the user to select the gear ratio.

DETAILED DESCRIPTION OF THE INVENTION

Figure 1:
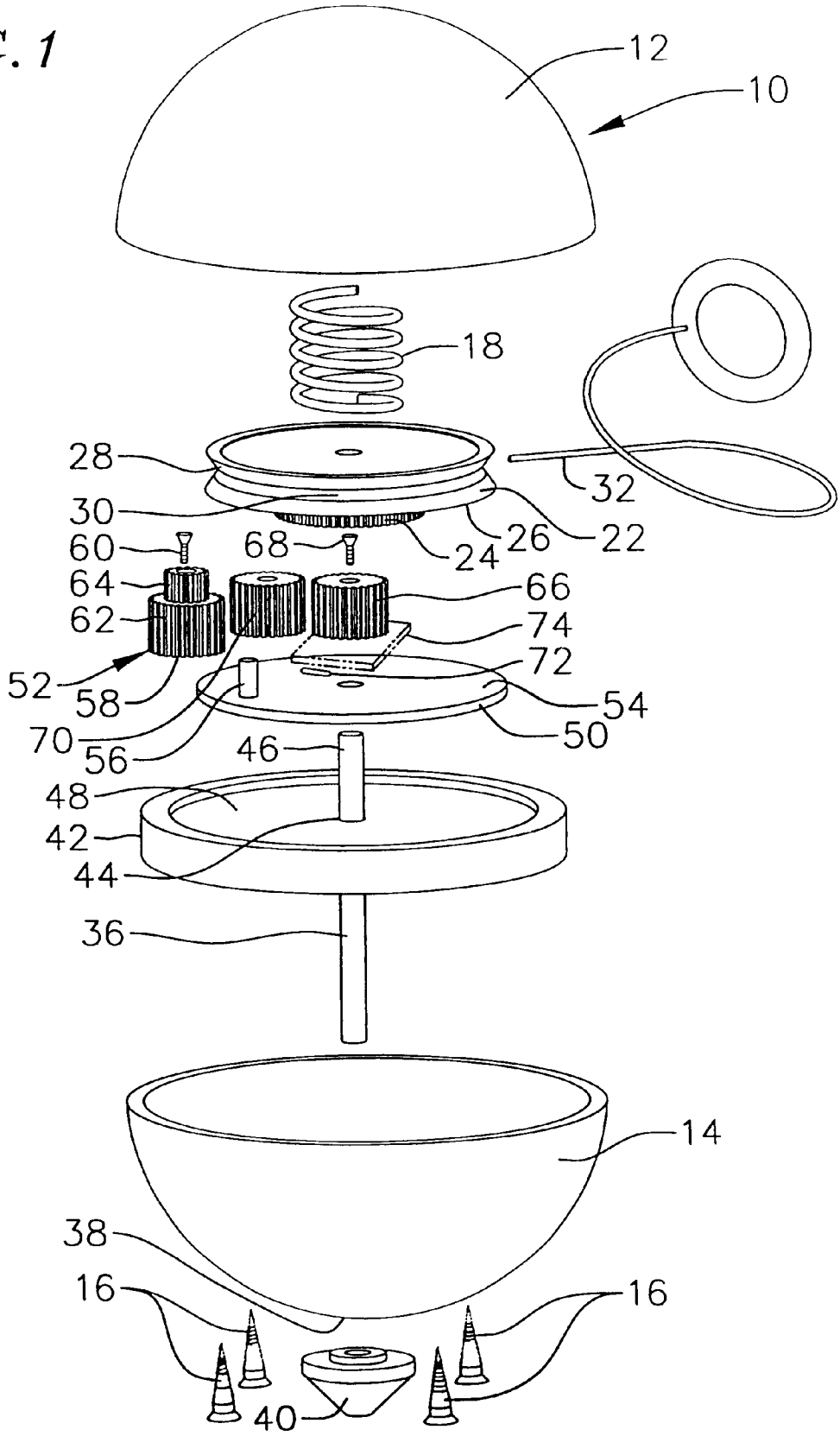
FIG. 1 is an exploded view of an embodiment of the gyroscopic toy of the present invention.
Figure 2:
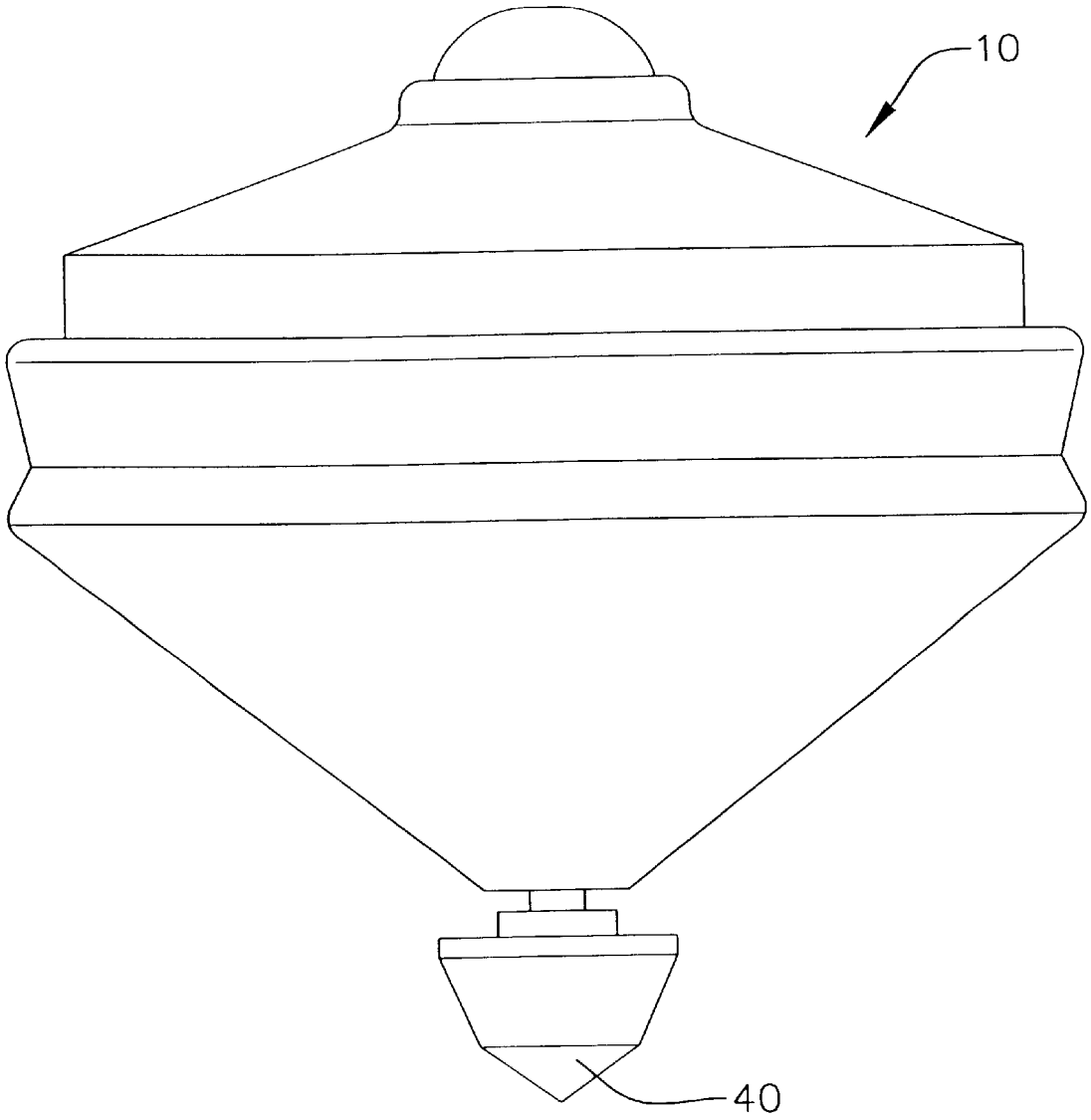
FIG. 2 is a perspective view of a gyroscopic toy of the present invention having a differently shaped body.
Figure 3A:
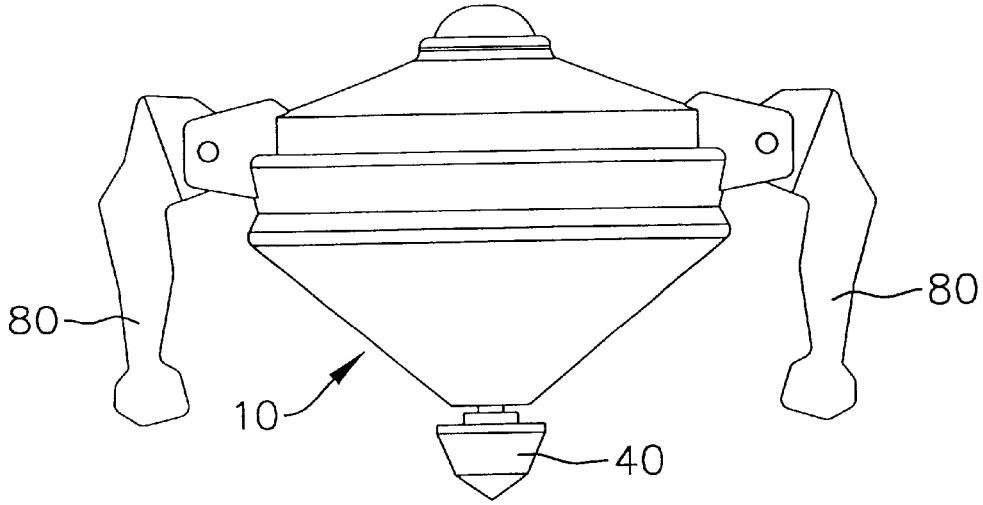
FIG. 3A is a front view of a gyroscopic toy of the present invention having a housing in the shape of robot having appendages.
Figure 3B:
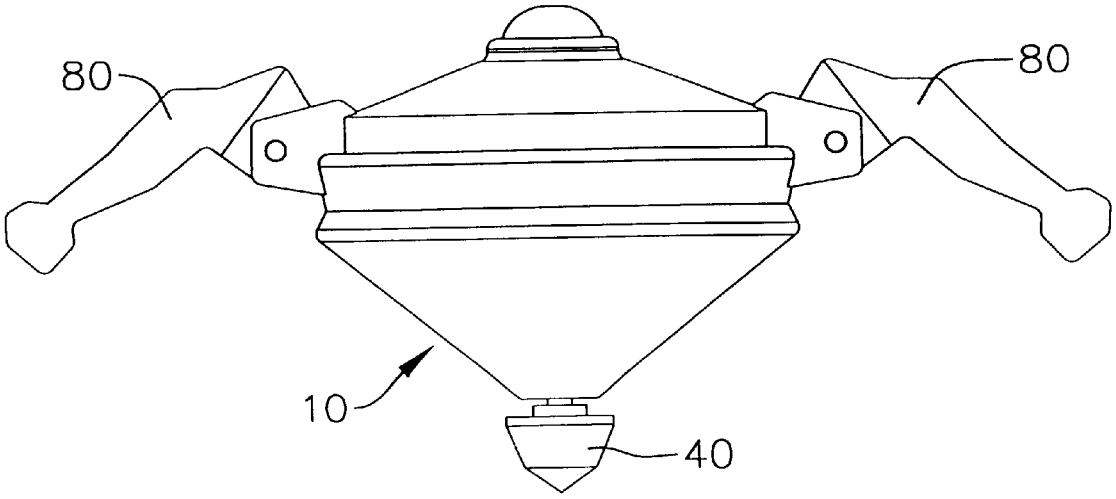
FIG. 3B is a front view of the gyroscopic toy shown in FIG. 3A showing the extension of the appendages during spinning.

In one embodiment, the gyroscopic toy of the present invention comprises a housing 10 having a top housing portion 12 and a bottom housing portion 14 (FIG. 1). The bottom portion 14 is typically fastened to the top portion with screws 16. However other fastening or attaching schemes may be used. The housing may be spherical as shown in FIG. 1 or have other geometric shapes such as for example those shown in FIGS. 2, 3A, 3B and 6A. The housing 10 may have appendages 80, such as those shown in FIGS. 3A and 3B, pivotally coupled to the housing. For example, the housing may be in the shape of a robot (or a human or other mammal) and the appendages may be the arms of the robot as shown in FIGS. 3A and 3B. When the gyroscopic toy is spinning the centrifugal force will cause the appendages to pivot outward as shown in FIG. 3B.

A torsion spring 18 is coupled to the top housing 12 and to a pulley/pinion combination 20. The pulley/pinion combination comprises a disc shaped pulley 22. A pinion 24 extends from a lower surface 26 of the pulley and is coaxial with the pulley. The pulley has a circumferential edge 28. An annular groove 30 is formed along the pulley circumferential edge 28. A string 32 is coiled within the annular groove. Typically, one end of the sting is attached to the annular groove. A finger pull-ring 34 may be connected to the other end of the string. The string can be made of fabric, nylon or other appropriate flexible/pliable materials. The string penetrates an opening (not shown) formed on the housing and extends to the exterior of the housing. The pull-ring is connected to the string exterior of the housing 10.

A shaft 36 extends from the interior of the housing to the bottom 38 of the bottom housing portion 14 and may even extend beyond the bottom housing. The shaft is fixed axially relative to the bottom housing but is free to rotate about its central axis relative to the bottom housing. This can be accomplished, for example, using a bearing mechanism (not shown) fitted around the shaft and connected to the bottom housing portion. A pivot point tip 40 is attached to the shaft from the external surface of the bottom housing. Preferably, the tip is treaded to the shaft.

A flywheel 42 is fitted over the shaft such that the shaft penetrates the flywheel through the flywheel center 44. The flywheel is coupled to the shaft such that rotation of the shaft rotates the flywheel. A portion 46 of the shaft 36 extends above an upper surface 48 of the flywheel.

A gear plate 50 is fitted over the shaft portion 46 extending above the upper surface of the flywheel. The shaft 36 penetrates the gear plate but is not fixed to the gear plate. In this regard, rotation of the shaft will not by itself cause the gear plate to rotate. An outer gear 52 is pivotally coupled to an upper surface 54 of the gear plate. Preferably, the gear plate comprises a pin 56 extending perpendicularly from the gear plate upper surface 54. The outer gear comprises a central opening 58 to accept the pin 56. The outer gear is mated to the pin such that it can rotate about the pin 56. This can be accomplished by fastening the outer gear to the pin using a fastener such a screw 60. For example, the pin 56 may be provided with a threaded axial opening. In other words, the pin may be cylindrical. After the outer gear is fitted over the pin, a screw 60 may be used to fasten axially the outer gear to the pin.

The outer gear 52 preferably has two sections. A first lower section 62 and a second upper section 64 coaxially above the first section. In one embodiment shown in FIG. 1 the lower section has a larger diameter than the upper section. In an alternate embodiment, the first section may have a smaller diameter than the second section. In yet another embodiment, the outer gear may comprise of a single section, i.e., two sections having the same diameter. For illustrative purposes, the present invention is described as having an outer gear having two sections of different diameter.

A drive gear 66 is fixed to the shaft 36 over the upper surface 54 of the gear plate 50 such that rotation of the drive gear rotates the shaft about the shaft's central axis. The drive gear is not fixed to the gear plate 50 and can rotate relative to the gear plate. The drive gear can be fastened to the shaft using a fastener such as a screw 68. The drive gear can also be mounted to the shaft using a bearing mechanism (not shown) that allows the drive gear to impart a rotational force to the shaft about the shaft axis only in one direction. In this regard, when the drive is rotated in one direction it will cause the shaft to rotate in the same direction, whereas when the gear is rotated in the opposite direction it will rotate relative to the shaft without rotating the shaft. This type of mechanism allows the shaft to rotate relative to the drive gear.

A floating gear 70 is movably coupled to the gear plate for engaging, i.e., meshing, with the lower section 62 of the outer gear 52 and with the drive gear 66. The floating gear 70 is preferably always engaged to the outer gear 52. In one embodiment, the floating gear comprises a pin (not shown) extending along its central axis. A slot 72 is formed on the gear plate. The floating gear pin is fitted within the slot allowing the floating gear to float along the slot between a radially inward position engaging both the outer and drive gears and a radially outward position disengaging from the drive gear. Alternatively, the floating gear can be coupled to a floating plate 74 movably coupled to the gear plate. With this embodiment, the floating gear 70 can be fastened via a pin (not shown) to the floating plate 74. In this regard, the floating gear can rotate relative to the floating plate but cannot otherwise move relative to the floating plate. The floating plate may be coupled to the gear plate using a pin (not shown) riding in the slot 72. In this regard, the floating plate can move along the slot 72.

Figure 4A:
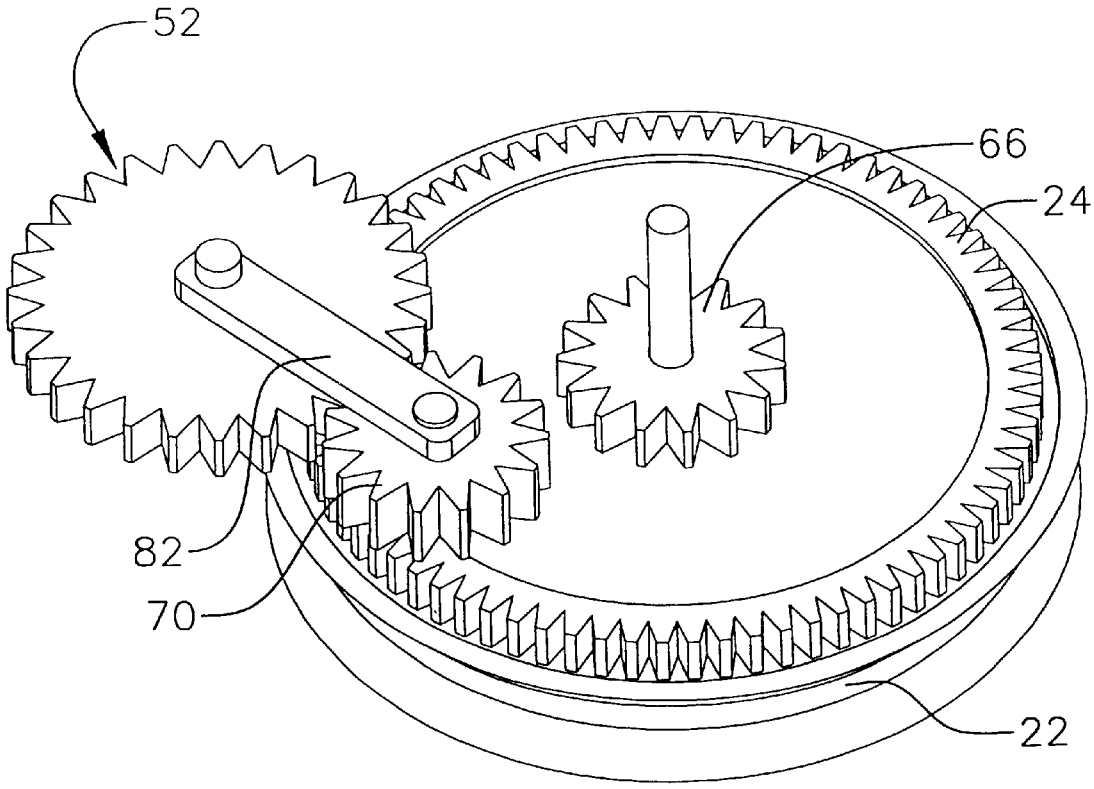
FIG. 4A is a bottom section view of an embodiment of the gear mechanism of the present invention looking upward from the gear plate and incorporating a floating bracket with the floating gear in a position disengaged from the drive gear.
Figure 4B:
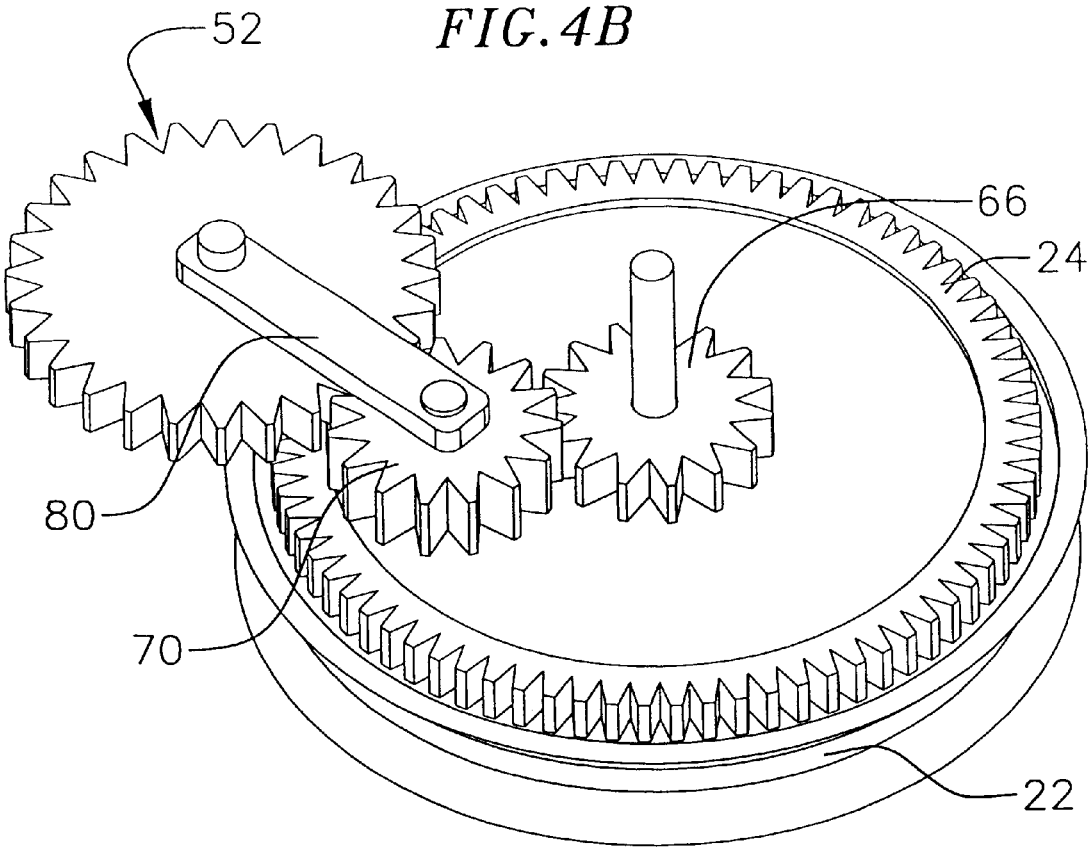
FIG. 4B is a bottom section view of the gear mechanism of shown in FIG. 4A with the floating gear in a position engaged to the drive gear.
Figure 4C:
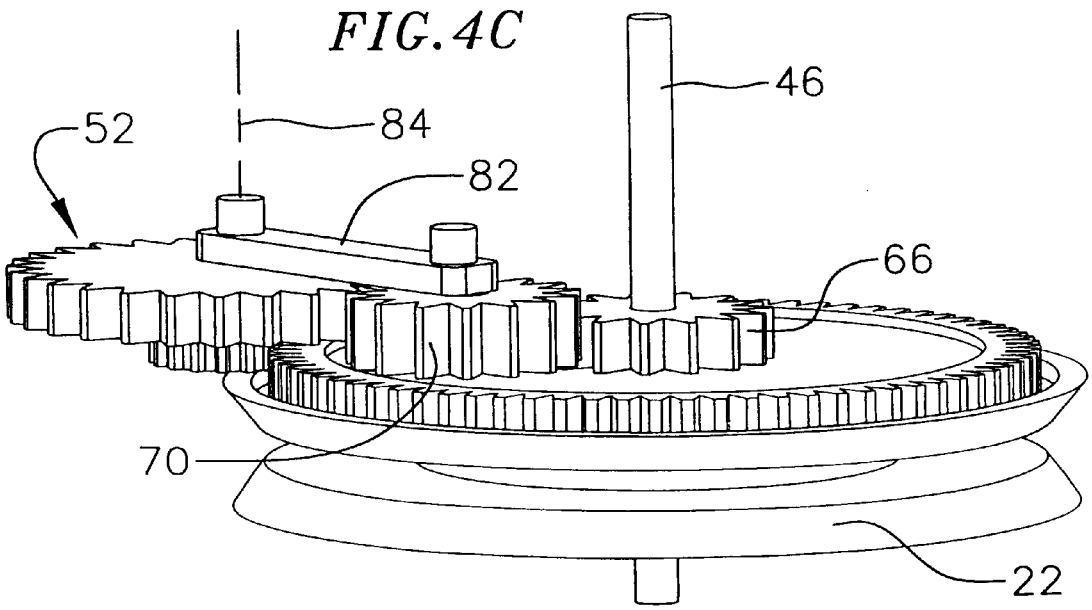
FIG. 4C is side upside down view of the gear mechanism shown in FIGS. 4A and 4B.

In yet a further embodiment, shown in FIGS. 4A–4C, the floating gear may be retained in an engaged position to the outer gear using a floating bracket 82. The floating bracket is pivotally coupled at one end about the axis of rotation 84 of the outer gear 52. The floating gear 70 is rotatably coupled to the other end of the floating bracket. The floating bracket can rotate about the axis 84 to bring the floating gear in and out of engagement with the drive gear 66 while maintaining engagement with the outer gear 52.

When the bottom housing is attached to top housing, the pinion 24 of the pulley meshes with the upper section 64 of the outer gear. To operate the top, the user pulls on the string 32 by pulling on the finger pull ring 34 with his finger. As a result, the pulley with pinion are rotated coiling the torsion spring. This rotation causes, the floating gear which is engaged by the outer gear to move radially inward to a position engaging both the outer gear and the drive gear. Consequently, the drive gear is caused to rotate and thus, spin the shaft, flywheel and the pivot point tip. Once the user releases the string, the torsion spring uncoils causing the pulley/pinion combination to rotate in an opposite direction and coiling the string in the pulley annular groove 30. This opposite rotation causes the outer gear to rotate in an opposite direction moving the floating gear in a radially outward direction disengaging from the drive gear. As the user further pulls on the string he imparts more spin energy on the flywheel as there is less torsional inertia to overcome causing the tip to spin faster and longer. The more times the user pulls the string the more spin energy imparted to the flywheel and the faster and longer that the top will spin.

In the embodiments depicted in FIG. 1 and FIGS. 4A–4C, a pull on the string 32 will cause the pulley/pinion combination 20 to rotate counter-clockwise as viewed from the top which in turn causes the outer gear 72 to rotate clockwise causing the floating gear 70 to move radially inward to engage the drive gear 66. It should be pointed that the gears can be arranged such that a clockwise rotation of the pulley/pinion combination by pulling on the string will cause the floating gear to move into position to engage the drive gear. Moreover, with any of the aforementioned embodiments, the gears can be positioned at different locations without departing from the scope of the invention. For example, the pulley/pinion combination may be mounted with the pinion located over the pulley. With this embodiment, the shaft will have to be long enough to penetrate the pulley/pinion combination and all the gears will be located above the pulley/pinion combination.

The gear ratio and specifically the reduction in gearing provided in the gyroscopic toys of the present invention allows for more spin energy to be imparted to the shaft and flywheel. It allows the user to incrementally increase the cumulative spin energy imparted on the flywheel. The gear reductions can be as great and even greater than 10:1. As the pinion gear of the pulley/pinion combination gets larger and/or the drive gear gets smaller, it becomes harder to pull the string especially during the initial pulls when the toy is at rest or at lower spin rates. However, each pull will provide more spin energy to the flywheel.

In another embodiment, a transmission may be provided that is manual or automatic, allowing the user to select the gear ratio much like a bicycler selects the gear ratio on his bike. For example, this can be accomplished by changing the size of any of the gears. One way to accomplish this would be to provide more than one outer gear with its associated floating gear on the gear plate or in a separate casing. The user can then select different gear ratios by rotating or moving the gear plate or casing to bring a different outer gear in engagement with the pinion of the pulley/pinion combination. The gear plate or casing may be coupled to one of the housing portions or to a lever. In this regard, the user will be able to rotate one housing portion relative to the other, move the lever or move the casing for changing gears. An example of such transmission is shown in FIGS. 5A–5D.

The transmission comprises a transmission casing 90 which is pivotally coupled to the gyroscopic top housing 10 (shown for example as a disk shaped housing in FIG. 6A) about a transmission pivoting axis 91 using a transmission casing pin 93 . With this embodiment, the outer gear 52*a* is a floating gear and comprises three sections, a first section 92, a second section 94 and a third section 96 (i.e., the first outer gear 52*a* is a compound gear). The second and third sections extend from opposite sides of the first section 92 and are coaxial with the first section. Preferably, the second and third sections have diameters which are smaller than the diameter of the first section. A floating bracket 82*a* is pivotally coupled about one end to the first outer gear 52*a* about the first outer gear axis 98. The floating gear 70 is coupled to the other end of the floating bracket 82*a,* as with embodiment shown in FIGS. 4A–4C, and is meshed with the first section 92 of the first outer gear. The floating gear extends to outside of the transmission casing 90 as shown in FIG. 5D.

A second outer gear 100 is pivotally coupled to the transmission casing 90. The second outer gear 100 is also a compound gear comprising two sections, a first section 102 and a second section 104 extending coaxially thereof. Preferably, the second section 104 has a smaller diameter than the first section 102 of the second outer gear. The first section 102 of the second outer gear is meshed to the third section 96 of the first outer gear. An intermediate gear 106 is coupled to the second section 104 of the second outer gear. The intermediate gear 106 is preferably retained in place by protruding through an opening 107 formed on the transmission casing 90 and by being positioned between the pulley 22 and the second gear first section 102. When the transmission casing 91 is pivoted about the transmission axis 91, the intermediate gear can also couple to the pinion gear of the pulley.

Figure 6A:
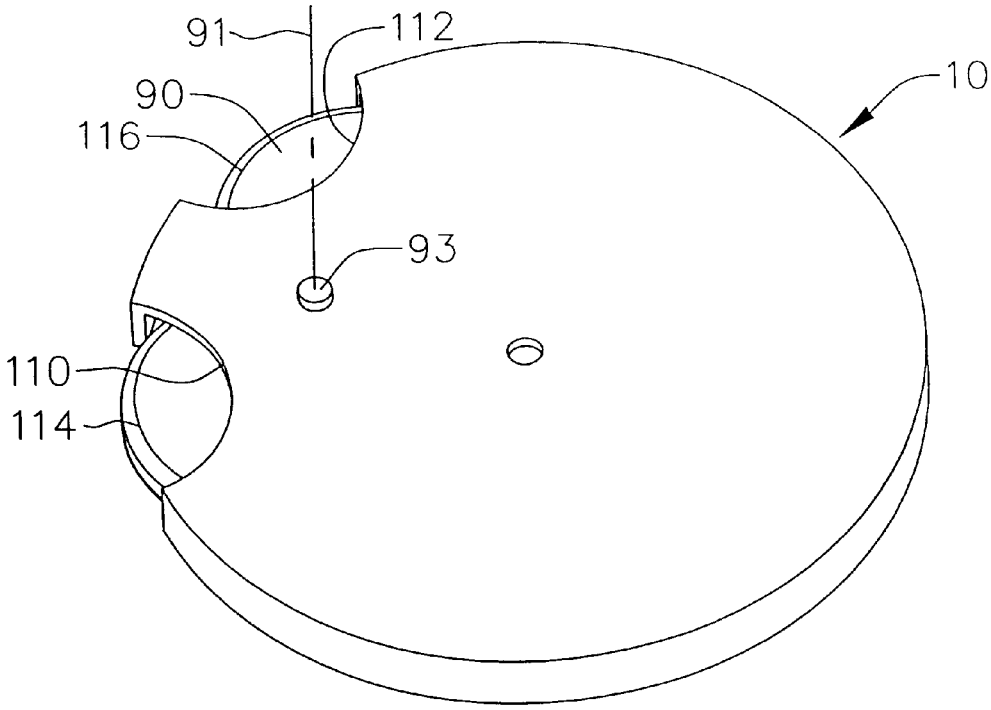
FIG. 6A is a perspective top view of a gyroscopic top housing incorporating a transmission casing.

The housing 10 of the gyroscopic top is formed with two openings 110, 112 extending from opposite sides of the transmission pivot axis 91 providing access to the transmission casing as shown in FIG. 6A. Alternatively, a single opening may used that is large enough to provide access to the transmission casing from either side of the transmission pivot axis.

Figure 7A:
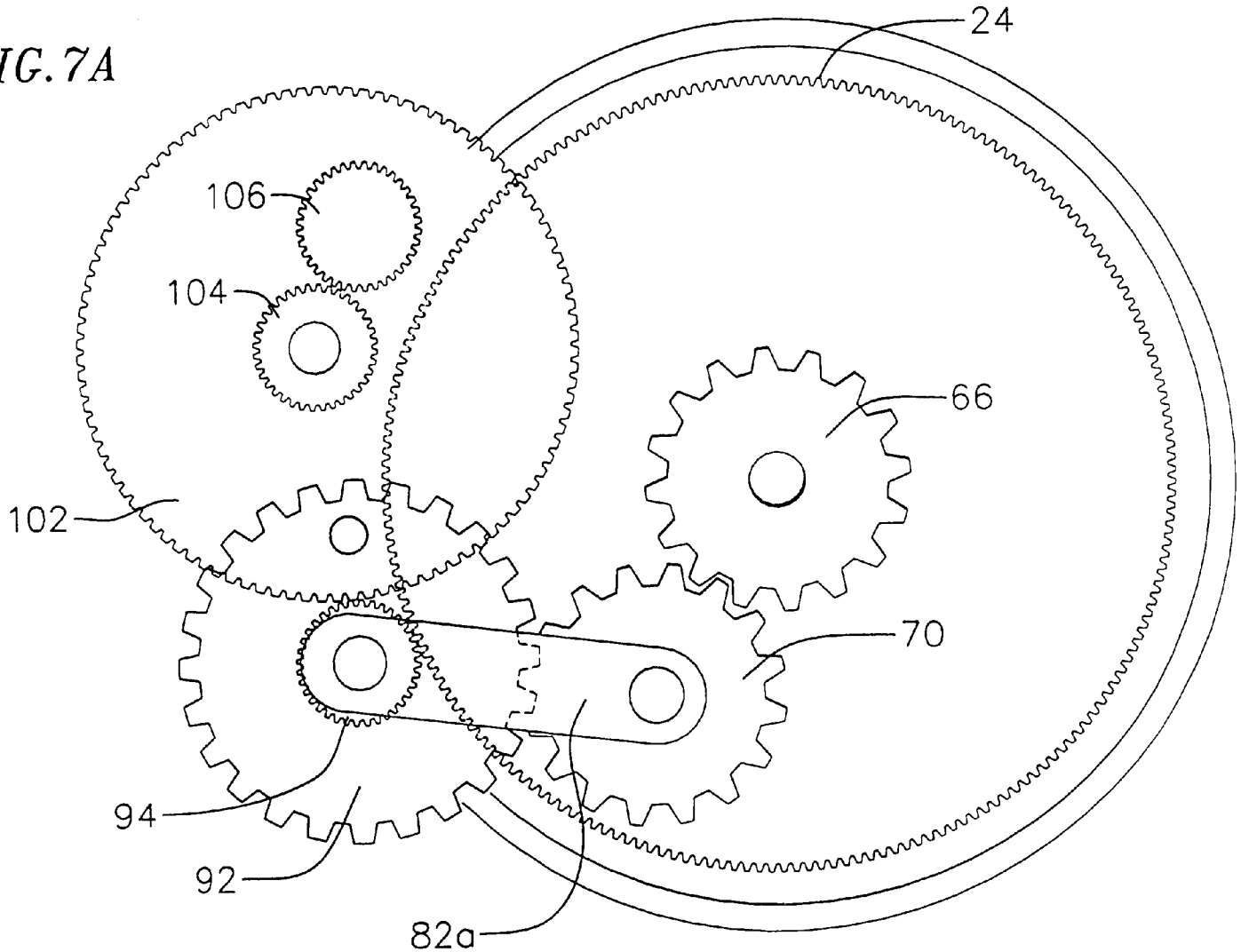
FIG. 7A is the section bottom view taken along arrows 5D–5D shown in FIG. 5A depicting the transmission without the casing engaged in a first gear.

To select the first gear, the operator of the gyroscopic top pushes on a transmission casing portion 114 from one side of the transmission pivot axis. When that occurs, the second section 94 of the first outer gear couples to the pinion 24 of the pulley while the intermediate gear remains decoupled from the pinion 24. Pulling on the string 32 causes the pulley and pinion 24 to rotate and the first outer gear to rotate causing the floating gear 70 to move with the floating bracket 82*a* and couple to the driving gear 66 as shown in FIG. 7A. The gyroscopic toy then operates as described above in relation with the previous embodiments.

Figure 7B:
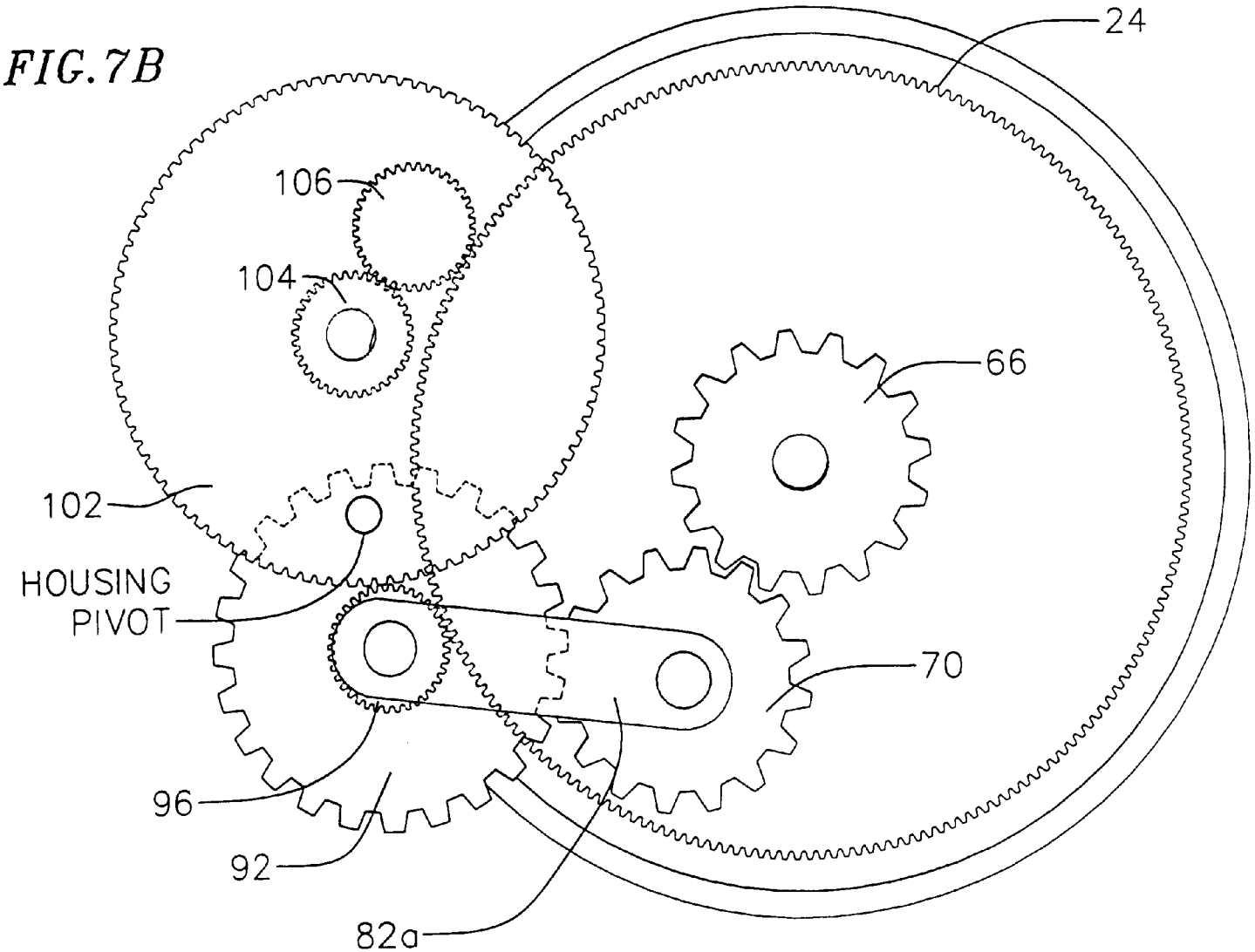
FIG. 7B is the section bottom view taken along arrows 5D–5D shown in FIG. 5A depicting the transmission without the casing engaged in a second gear.

To select the second gear, the operator pushes on a second transmission casing portion 116 causing the intermediate gear 106 to couple to the pulley pinion 24 while causing the first outer drive gear second section 94 to decouple from the pulley pinion 24 as shown in FIG. 7B. When the operator pulls on the string 32, it causes the intermediate gear 106 to rotate which causes the second outer gear first and second sections to rotate as well as the first outer gear whose third section 96 is coupled to the first section 104 of the second outer gear. When the first outer gear rotates it causes the floating gear 70 to move with the floating bracket 82*a* and couple to the drive gear 66 causing the gyroscopic top 36 to spin as shown in FIGS. 7B and 5B.

Figure 5A:
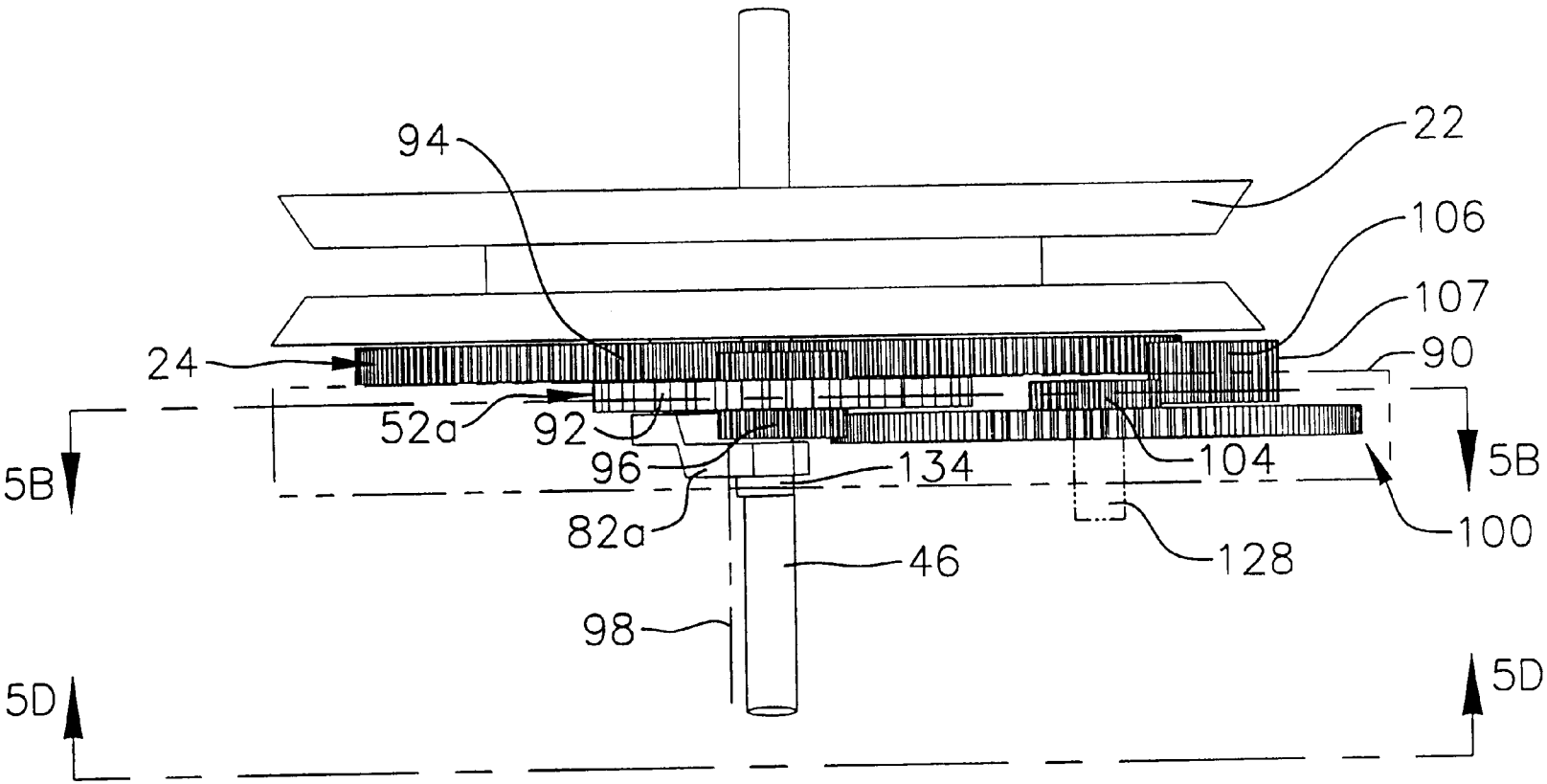
FIG. 5A is a side view of a gear mechanism of a transmission incorporated in the gyroscopic toy of the present invention.
Figure 5B:
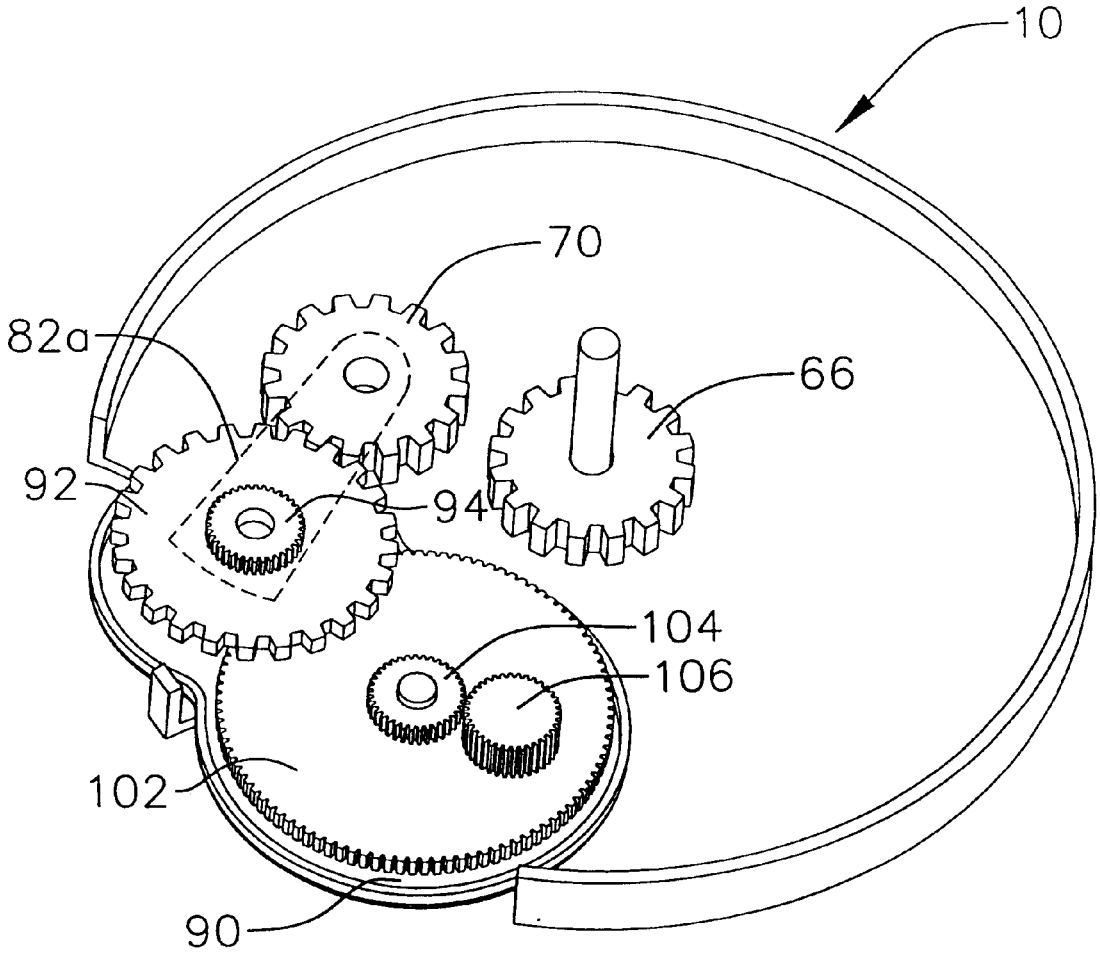
FIG. 5B is a section top view taken along arrows 5B–5B shown in FIG. 5A immediately below the pulley/pinion and shows the transmission gearing mechanism shown in FIG. 5A with the floating gear disengaged from the drive gear.
Figure 5C:
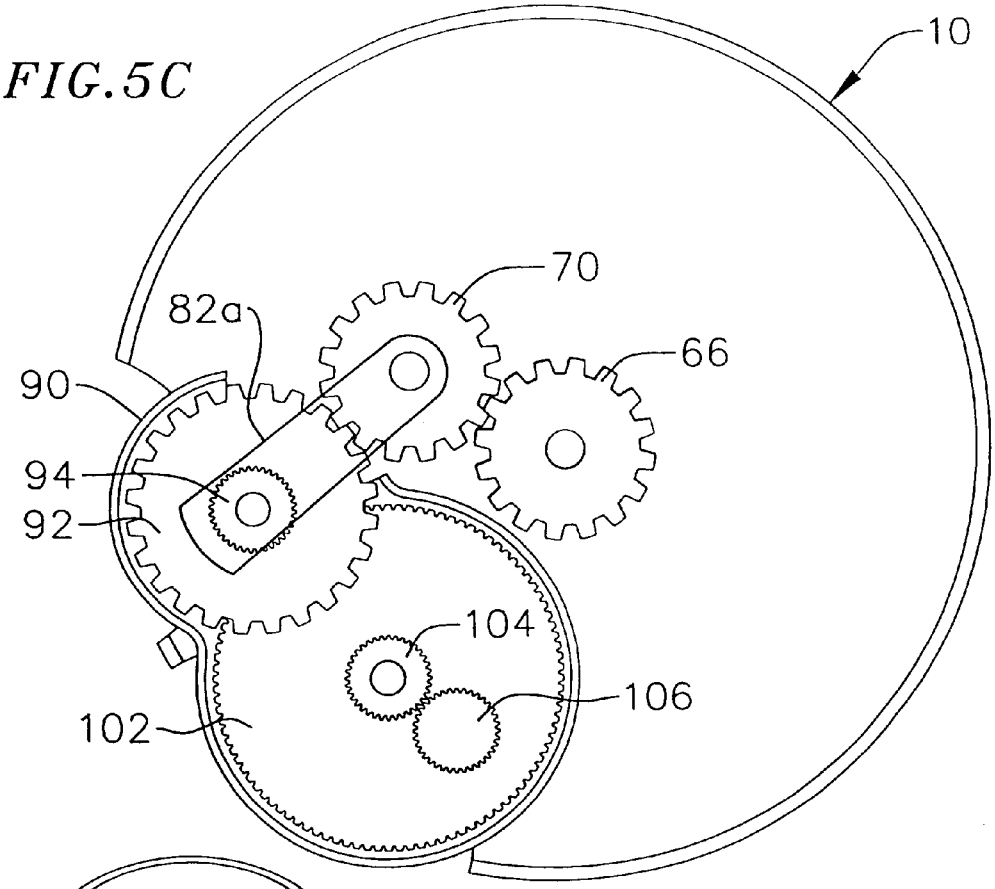
FIG. 5C is a section top view of the transmission gearing mechanism shown in FIG. 5B with the floating gear engaged to the drive gear.
Figure 5D:
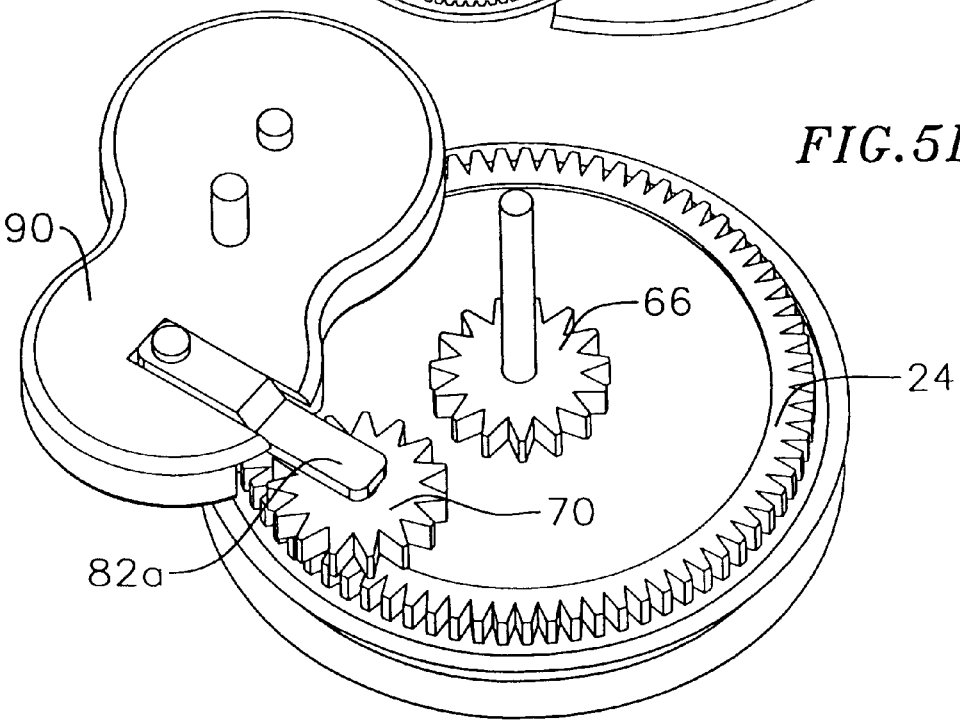
FIG. 5D is a section bottom view taken along arrows 5D–5D shown in FIG. 5A depicting the transmission casing.

With either gear selection, when the string is released, and the torsion spring 18 uncoils the first drive gear rotates in an opposite direction causing the floating bracket 82a to pivot and the floating gear 70 to decouple from the drive gear 66 as shown in FIG. 5B.

The two gears (i.e., gear ratios) provided by the transmission can be changed by changing the diameters of the gears. For example, this may accomplished by using a first drive gear whose second section 94 diameter is different from the intermediate gear 106 diameter.

In one embodiment using the transmission described above, a gear plate is not incorporated into the top. With this embodiment, the operator may keep the selected gears engaged by applying pressure to the appropriate section 114 or 116 of the transmission casing while pulling on the string. During pulling of the string the gears will remain engaged even without pressing on the transmission casing due to the direction of rotation of the gears.

Figure 6B:
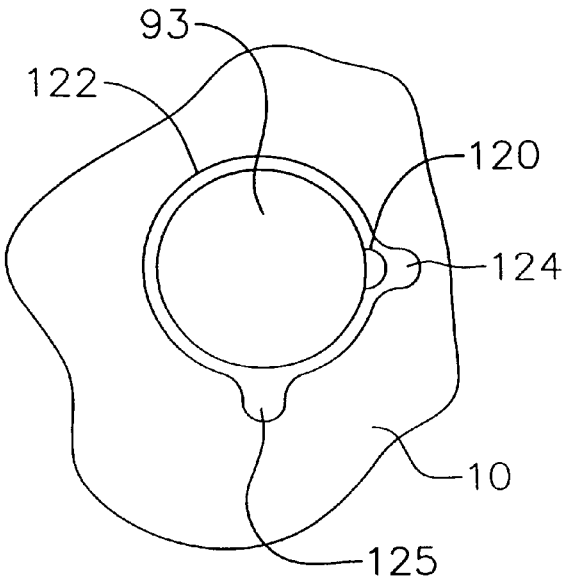
FIG. 6B is a top view of a section of the housing shown in FIG. 6A incorporating an opening accommodating the transmission pivot pin.

Alternatively, the transmission casing may be retained engaged in the selected gear by providing a small protrusion 120 extending from the transmission pivot pin 93 as shown in FIG. 6B. The housing 10 is provided with an opening 122 to accommodate the transmission pin. The opening 122 is provided with two small notches 124, 125 to accommodate the protrusion, thus, forming a detent mechanism. When the operator pushes the transmission casing into first gear, the transmission pivot pin rotates until the protrusion 120 engages the first notch 124. The notch 124 retains the protrusion 120 and maintains the transmission gears engaged in first gear. Likewise when the operator pushes the transmission casing into second gear, the transmission pivot rotates causing the protrusion to disengage from the first notch and engage the second notch 125. As the protrusion engages a notch it provides the operator with a "clicking" feel signifying that the selected gear is engaged.

Figure 8:
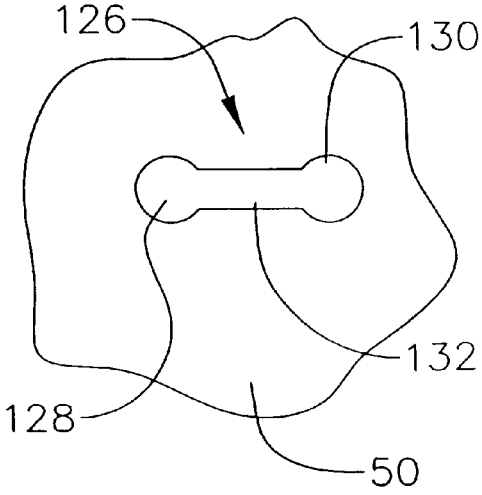
FIG. 8 is a top view of a section of gear plate incorporating a key hole slot.

In an alternate embodiment, a gear plate 50 is used having a key hole slot 126 having first and second wider sections 128, 130 interconnected by narrower section 132 as shown in FIG. 8. A pin 128 extending coaxially from the second outer gear and through the transmission casing is fitted within the first or second sections of the slot 126. When in a selected gear, the pin is retained within one wider section by the narrower section thereby preventing disengagement from the selected gear. When the casing is pushed for selecting another gear the pin is moved to the other wider section and retained there. As the pin 128 moves between the wider sections of the slot 126 the operator is again provided with a "clicking" feel as the pin enters a wider section. Alternatively, a pin 134 extending coaxially from the first outer gear is fitted within a key hole slot formed on the gear plate for retaining the gear casing in the selected gear.

Because the present inventive gyroscopic top can spin at higher speeds, it can incorporate a lighter flywheel which in turn reduces the weight and the cost of the gyroscopic toys.

The terms "upper", "lower", "top" and "bottom" as used herein are relative terms used for descriptive purposes and not meant to define absolute positions.

What is claimed is:

1. A gyroscopic toy comprising:

a housing;

a shaft coupled to the housing and extending in the housing, wherein the shaft can rotate relative to the housing;

a flywheel coupled to the shaft wherein rotation of the shaft rotates the flywheel;

a gear plate penetrated by the shaft;

a drive gear coupled to the shaft wherein rotation of the drive gear causes rotation of the shaft;

a first gear coupled to the gear plate;

a floating gear coupled to the gear plate, wherein the floating gear can move from a first position to a second position, wherein when in the first position, the floating gear is coupled to the drive gear and to the first gear, and wherein when in the second position, the floating gear is decoupled from the drive gear;

a pulley;

a pinion gear coupled to the pulley and to the first gear, wherein rotation of the pulley causes rotation of the pinion gear and thereby rotation of the first gear;

a torsion spring coupled to the pulley and to the housing, wherein rotation of the pulley torques the torsion spring; and a string wound around the pulley.

2. A toy as recited in claim 1 further comprising a tip extending from an end of the shaft, said tip being external of the housing.

3. A toy as recited in claim 2 wherein the tip is threaded on to the shaft.

4. A toy as recited in claim 1 further comprising:

a slot formed on the gear plate; and a pin extending from the floating gear and fitted within the slot, wherein the slot guides the movement of the pin and the gear between the first and second positions.

5. A toy as recited in claim 1 further comprising a floating plate, wherein the floating gear is rotatably coupled to the floating plate, and wherein the floating plate pivots to move the floating gear between the first and second positions.

6. A toy as recited in claim 5 further comprising:

a slot formed on the gear plate;

a pin extending from the floating plate and fitted within the slot, wherein the slot guides the movement of the pin and thus of the floating plate and the floating gear between the first and second positions.

7. A toy as recited in claim 1 wherein the first gear is rotatably coupled to the gear plate about a rotating axis, the toy further comprising a floating bracket pivotally coupled to the gear plate about the rotating axis, wherein the floating gear is rotatably coupled to the floating bracket and wherein the bracket pivots about the rotating axis for moving the floating gear between the first and second positions.

8. A toy as recited in claim 1 wherein the first gear comprises two coaxial sections, wherein the floating gear is coupled to a first section of the first gear and wherein the pinion gear is coupled to the second section of the first gear.

9. A toy as recited in claim 8 wherein the first section has a greater diameter than the second section.

10. A toy as recited in claim 1 further comprising:

a second gear comprising a first section and a second section coaxial with the second gear first section, wherein the second gear first section is coupled to the first gear; and an intermediate gear coupled to the second section of the second gear wherein the intermediate gear can be coupled to the pinion gear, and wherein when the intermediate gear is coupled to the pinion gear, the first gear is decoupled from the pinion gear.

11. A gyroscopic toy comprising:

a housing;

a shaft coupled to the housing and extending in the housing, wherein the shaft can rotate relative to the housing;

a flywheel coupled to the shaft wherein rotation of the shaft rotates the flywheel;

a gear plate penetrated by the shaft;

a drive gear coupled to the shaft wherein rotation of the drive gear causes rotation of the shaft;

a first gear coupled to the gear plate;

a floating gear coupled to the gear plate, wherein the floating gear can move from a first position to a second position, wherein when in the first position, the floating gear is coupled to the drive gear and to the first gear, and wherein when in the second position, the floating gear is decoupled from the drive gear;

a pulley;

a pinion gear coupled to the pulley and to the first gear, wherein rotation of the pulley causes rotation of the pinion gear and thereby rotation of the first gear;

a torsion spring coupled to the pulley and to the housing, wherein rotation of the pulley torques the torsion spring; and a string wound around the pulley, wherein as the string is being pulled it causes the pulley to rotate in a first direction causing the first gear to rotate in a direction for moving the floating gear to the first position and rotating the shaft and torquing the torsion spring for generating a force for rotating the pulley in an opposite second direction when the string is released, wherein as the pulley rotates in the second direction it causes the floating gear to decouple from the drive gear.

12. A gyroscopic toy comprising:

a housing;

a shaft coupled to the housing and extending in the housing, wherein the shaft can rotate relative to the housing;

a flywheel coupled to the shaft wherein rotation of the shaft rotates the flywheel;

a drive gear coupled to the shaft wherein rotation of the drive gear causes rotation of the shaft;

a pulley;

a pinion gear coupled to the pulley;

a torsion spring coupled to the pulley and to the housing, wherein rotation of the pulley torques the torsion spring;

a string wound around the pulley; and a transmission pivotally coupled to the housing, the transmission comprising, a first gear comprising a first section, a second section and third sections wherein the three sections are coaxial, a floating bracket pivotally coupled to the first gear, a floating gear pivotally mounted on the floating bracket and coupled to the first gear first section, a casing pivotally coupled to the housing, a second gear coupled to the casing and having a first section coaxial with a second section, wherein the second gear first section is coupled to the third section of the first gear, and an intermediate gear coupled to the second section of the second gear, wherein the casing can pivot between a first and a second position, wherein when in the first position, the first gear second section is coupled to the pinion and the intermediate gear is decoupled from the pinion and when in the second position, the first gear second section is decoupled from the pinion and the intermediate gear is coupled to the pinion, and wherein rotation of the first gear in a first direction causes the floating gear to couple with the drive gear and wherein rotation of the first gear in the opposite direction causes the floating gear to decouple from the drive gear.

13. A toy as recited in claim 12 wherein the first gear first section and the intermediate gear have different diameters.

14. A toy as recited in claim 12 further comprising a tip extending from an end of the shaft, said tip being external of the housing.

15. A toy as recited in claim 12 further comprising means for retaining the casing in a position.

16. A gyroscopic toy comprising:

a housing;

a shaft coupled to the housing and extending in the housing, wherein the shaft can rotate relative to the housing;

a flywheel coupled to the shaft wherein rotation of the shaft rotates the flywheel;

a pinion gear;

a first gear;

a drive gear coupled to the shaft wherein rotation of the drive gear causes rotation of the shaft, wherein rotation of the pinion gear in a first direction causes the first gear to couple to the drive gear and rotate the drive gear and wherein rotation of the pinion gear in a second direction opposite the first direction causes the first gear to decouple from the drive gear; and a floating gear wherein the floating gear couples the first gear to the drive gear when the pinion gear is rotated in a first direction and decouples the first gear from the drive gear when the pinion gear is rotated in the second opposite direction.

17. A gyroscopic toy comprising:

a housing;

a shaft coupled to the housing and extending in the housing, wherein the shaft can rotate relative to the housing;

a flywheel coupled to the shaft wherein rotation of the shaft rotates the flywheel;

a pinion gear;

a first gear;

a drive gear coupled to the shaft wherein rotation of the drive gear causes rotation of the shaft, wherein rotation of the pinion gear in a first direction causes the first gear to couple to the drive gear and rotate the drive gear and wherein rotation of the pinion gear in a second direction opposite the first direction causes the first gear to decouple from the drive gear;

a pulley coaxially coupled to the pinion gear; and a string coupled to the pulley, wherein pulling on the string causes the pulley and pinion gear to rotate in the first direction.

18. A toy as recited in claim 17 further comprising a torsion spring coupled to the pinion gear and the housing, wherein rotation of the pinion gear in the first direction torques the spring generating a torque for rotating the pinion gear in the second direction.

19. A gyroscopic toy comprising:

a housing;

a shaft coupled to the housing and extending in the housing, wherein the shaft can rotate relative to the housing;

a flywheel coupled to the shaft wherein rotation of the shaft rotates the flywheel;

a pinion gear;

a first gear;

a drive gear coupled to the shaft wherein rotation of the drive gear causes rotation of the shaft, wherein rotation of the pinion gear in a first direction causes the first gear to couple to the drive gear and rotate the drive gear and wherein rotation of the pinion gear in a second direction opposite the first direction causes the first gear to decouple from the drive gear;

a second gear coupled to the first gear; and an intermediate gear coupled to the second gear, wherein the intermediate gear can couple to the pinion gear and wherein when the pinion gear rotates in the first direction it causes the second gear and the first gear to rotate and the first gear to couple to the drive gear and when the pinion gear rotates in the second direction, the first gear decouples from the drive gear.

20. A gyroscopic toy comprising:

a housing;

a shaft coupled to the housing and extending in the housing, wherein the shaft can rotate relative to the housing;

a flywheel coupled to the shaft wherein rotation of the shaft rotates the flywheel;

a pinion gear;

a drive gear coupled to the shaft wherein rotation of the drive gear causes rotation of the shaft; and gearing coupled to the pinion gear, wherein rotation of the pinion gear in a first direction causes the gearing to couple to the drive gear, and wherein rotation of the pinion gear in a second direction opposite the first direction causes the gearing to decouple from the drive gear; and a transmission, the transmission comprising two gearing sets for coupling to the pinion gear and to the drive gear when the pinion gear is rotated in the first direction.

21. A toy as recited in claim 20 further comprising means for selecting the gearing which would couple to the drive gear when the pinion gear is rotated in a first direction.

22. A toy as recited in claim 20 wherein the gearing ratio of the first set is different from the gearing ratio of the second set.

* * * * *